US007458847B1

(12) United States Patent
Hsu et al.

(10) Patent No.: US 7,458,847 B1
(45) Date of Patent: Dec. 2, 2008

(54) CONNECTION ASSEMBLY FOR OFFSETTING TILTING

(75) Inventors: Yuan-Liang Hsu, Taipei (TW); Lien-Hsun Ho, Taipei (TW); Tung-Yuan Chen, Taipei (TW); Chao-Yi Wu, Taipei (TW)

(73) Assignee: Cyber Power System Inc., Taipei (TW)

( * ) Notice: Subject to any disclaimer, the term of this patent is extended or adjusted under 35 U.S.C. 154(b) by 0 days.

(21) Appl. No.: 11/802,869

(22) Filed: May 25, 2007

(51) Int. Cl.
*H01R 13/60* (2006.01)

(52) U.S. Cl. ..... 439/568; 439/352; 439/285; 439/924.2

(58) Field of Classification Search ..... 439/568, 439/352, 357, 285, 924.2
See application file for complete search history.

(56) References Cited

U.S. PATENT DOCUMENTS 4,990,099 A * 2/1991 Marin et al. ..... 439/284
5,727,969 A * 3/1998 Yamanashi ..... 439/594
6,364,718 B1 * 4/2002 Polgar et al. ..... 439/680
6,447,346 B2 * 9/2002 Sasaki et al. ..... 439/262
6,475,010 B1 * 11/2002 Yu ..... 439/289
6,746,266 B2 * 6/2004 Cheng ..... 439/352
7,128,470 B2 * 10/2006 Scherer et al. ..... 385/59
7,153,170 B1 * 12/2006 Fabian ..... 439/680
7,168,534 B2 * 1/2007 Loszewski ..... 188/251 A

* cited by examiner

*Primary Examiner*—Truc T Nguyen
(74) *Attorney, Agent, or Firm*—Muncy, Geissler, Olds & Lowe, PLLC

(57) ABSTRACT

A connection assembly for offsetting tilting caused by weight difference between two objects includes a first male connector, a second male connector linearly misaligned with the first male connector, a first female connector and a second female connector linearly misaligned with the first female connector. Both the first and second male connectors are formed on a first object and both the first and second female connectors are formed on a second object. Due to the misaligned relationship, weight of the combination between the first object and the second object is redistributed to avoid tilting.

14 Claims, 4 Drawing Sheets

CONNECTION ASSEMBLY FOR OFFSETTING TILTING

BACKGROUND OF THE INVENTION

1. Field of the Invention

The present invention relates to a connection assembly, and more particularly to a connection assembly for offsetting tilting situation especially when two objects of unbalanced weights are to be combined.

2. Description of the Prior Art

A conventional connection assembly for connecting two objects together includes two extensions formed on one object and two indentations corresponding to the two extensions and formed on the other object. When combination of these two objects is required, the two extensions are extended into the two indentations to complete the combination of these two objects. However, if the two objects are each of a different weight, the combination of these two objects will cause a tilting effect after the completion of the combination. That is, after the combination, the center of gravity of the combination is tilted toward the heavy one. When transportation of the combination is required, the connection assembly is easily broken due to the unbalanced weight distribution.

A perfect example of this connection assembly can be understood in the connection between a UPS (uninterrupted power supply) and an appliance in associated with the UPS. As is well known in the art, the weight of the UPS is usually much heavier than that of the appliance such that after the UPS is connected to the appliance, the overall weight of the combination is mostly focused on the UPS, which causes a tilting effect to the combination. Therefore, when the combination is to be transported, the worker has to be extra careful in handling the combination. Otherwise, the combination of the UPS and the appliance is easily damaged and the connection therebetween is easily broken.

To overcome these shortcomings, the present invention tends to provide an improved connection assembly to mitigate the aforementioned problems.

SUMMARY OF THE INVENTION

The primary objective of the present invention is to provide an improved connection assembly having a pair of male connectors adapted to be formed on a first object and a pair of female connectors adapted to be formed on a second object and corresponding to the pair of male connectors so that after the pair of male connectors is extended into the pair of female connectors, the first object and the second object are securely connected with each other. Each of the pair of male connectors adapted to be formed on the first object is offset to each other and each of the pair of female connectors adapted to be formed on the second object is also offset to each other so that the connection between the first object and the second object shifts part of the overall weight of the combination of the first object and the second object to accomplish balance purpose.

In order to accomplish the aforementioned objective, the connection assembly of the present invention includes a first male connector, a first cutout adapted to be formed on a side face of the first object and a second male connector extending from a side face defining the first cutout so that the first male connector and the second male connector are zigzag to one another. The connection assembly further includes a first female connector adapted to be formed on a side face of the second object, a second cutout adapted to be defined in the side face of the second object and a second female connector formed on a side face defining the second cutout so that the first female connector and the second female connector are zigzag to each other. Therefore, insertion of the first male connector and of the second male connector into the first female connector and the second female connector, respectively, redistributes the weight of the combination evenly.

Other objects, advantages and novel features of the invention will become more apparent from the following detailed description when taken in conjunction with the accompanying drawings.

DETAILED DESCRIPTION OF THE PREFERRED EMBODIMENT

Figure 1:
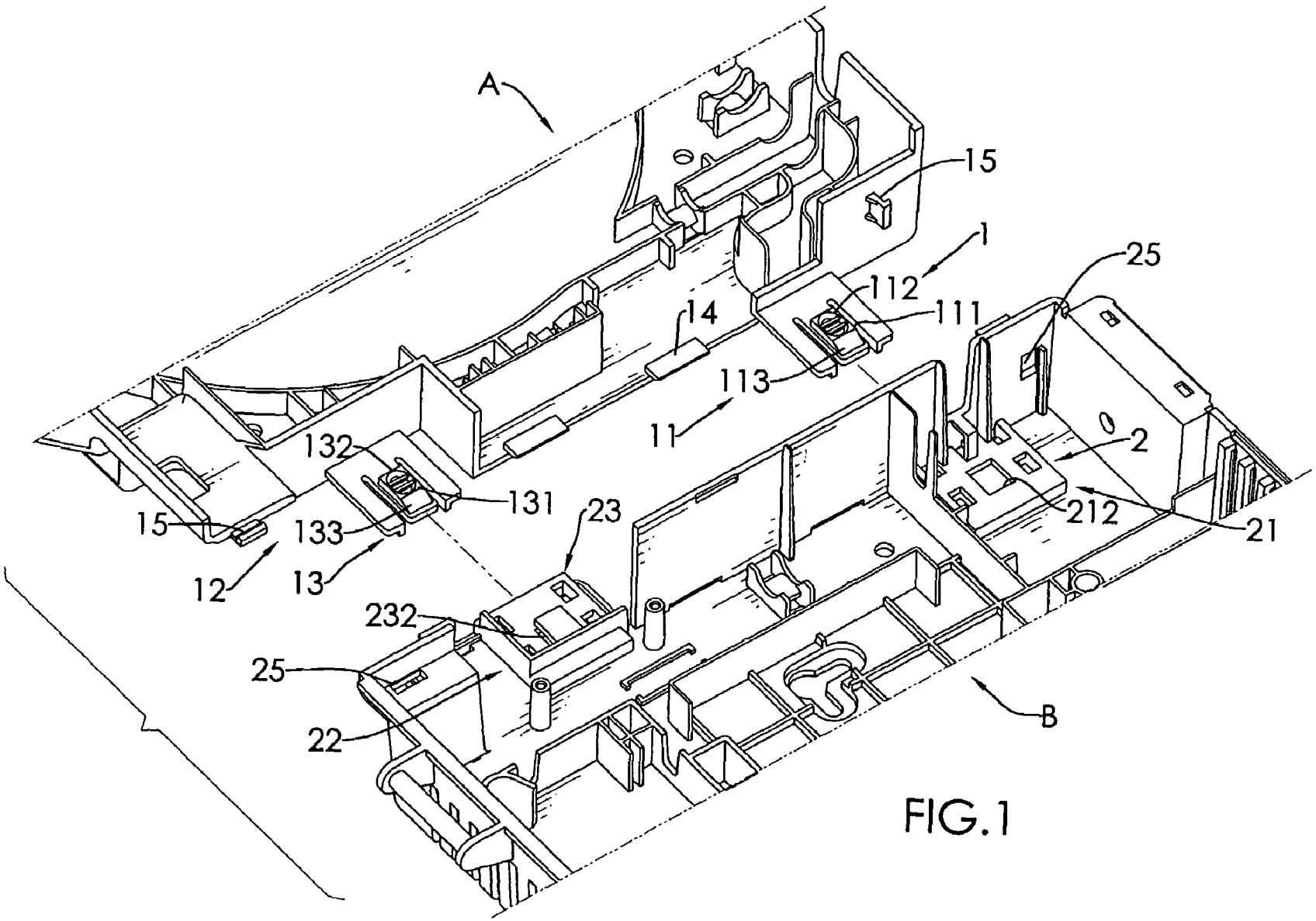
FIG. 1 is a perspective view of the connection assembly of the present invention.
Figure 2:
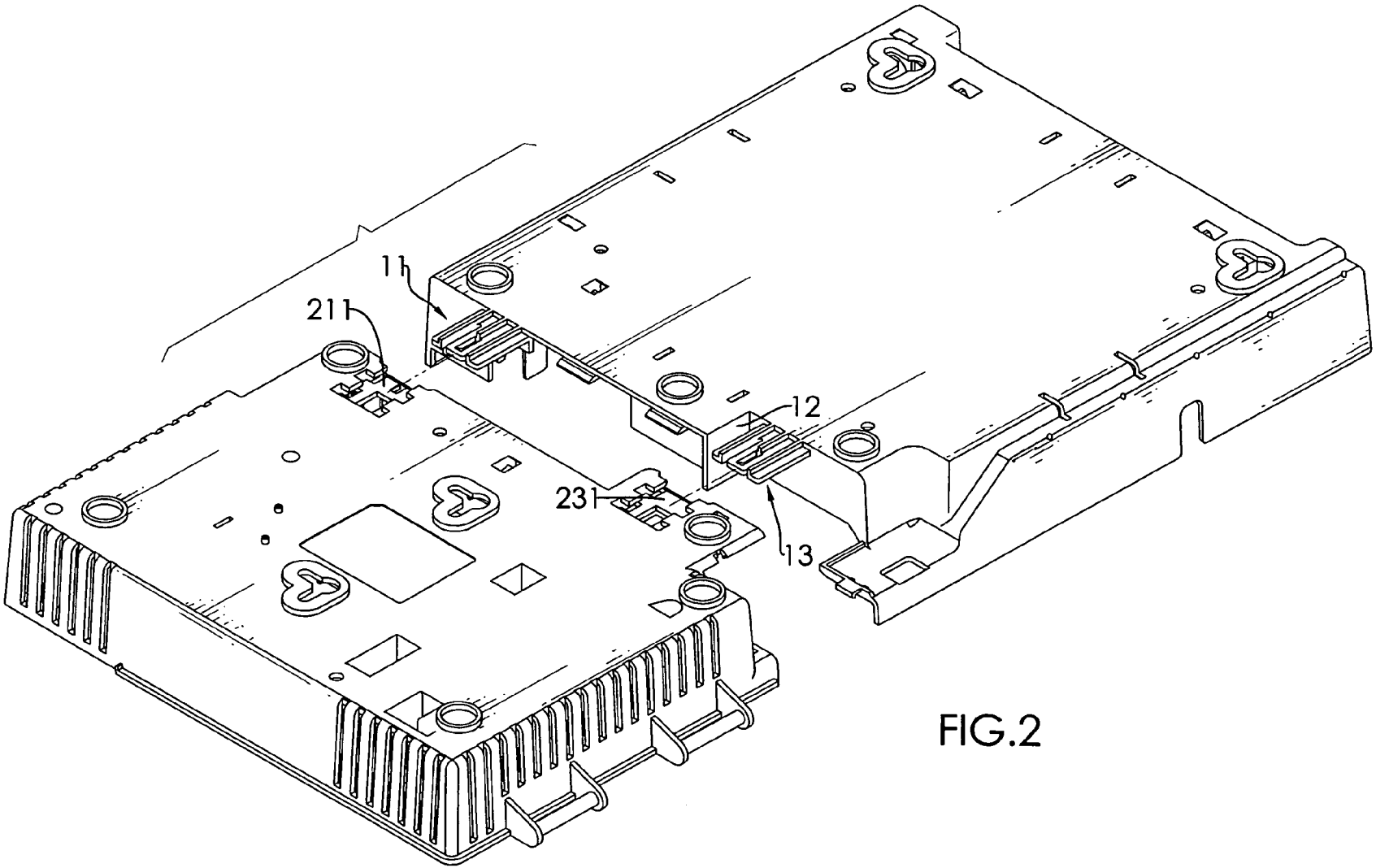
FIG. 2 is a perspective view of the connection assembly of the present invention in a different angle relative to that of FIG. 1.

With reference to FIGS. 1 and 2, it is noted that the connection assembly in accordance with the present invention include a pair of male connectors (1) formed on a side face of a first object (A) and a pair of female connectors (2) formed on a side face of a second object (B).

The pair of male connectors (1) is composed of a first male connector (11) formed on a longitudinal side face of the first object (A), a first cutout (12) defined in the longitudinal side face of the first object (A) and a second male connector (13) formed and extending out from a side face defining the first cutout (12). Due to the provision of the first cutout (12), the first male connector (11) is zigzag to the second male connector (13). That is, in this preferred embodiment, the second male connector (13) has a length the same as the depth of the first cutout (12) so that the second male connector (13) is flush with the longitudinal side face of the first object (A). Each of the first male connector (11) and of the second male connector (13) has a tongue (111, 131) respectively stamped in the first male connector (11) and in the second male connector (13), a boss (112, 132) respectively formed on a mediate portion of the tongue (111, 131) and a wedge (113, 133) formed on a free end of the tongue (111, 131). Due to the provision of the first cutout (12), the first male connector (11) is zigzag to the second male connector (13). That is, the first male connector (11) is not in linear alignment with the second male connector (13).

The connection assembly of the present invention further includes a first female connector (21) formed on a longitudinal side face of the second object (B) to correspond to the first male connector (11) of the first object (A), an extension (22) protruding from the longitudinal side face of the second object (B) formed on a side face of a longitudinal side face of the second object (B) and a second female connector (23) formed on a free side of the extension (22) to correspond to the second male connector (13) of the first object (A). It is noted that due to the provision of the extension (22) on the second object (B), the first female connector (21) is zigzag to the second female connector (23). Furthermore, each of the first female connector (21) and of the second female connector (23) has a indentation (211, 231) respectively defined in the bottom face of the longitudinal side face and of the extension (22) to correspond to and receive therein the first male connector (11) and the second male connector (13), respectively. In addition to the indentation (211, 231), the first female connector (21) and the second female connector (23) each have a through hole (212, 232) defined through a side face defining the indentation (211, 231) to receive therein the bosses (112, 132) of the first male connector (11) and of the second male connector (13). Two guiding holes (24) are defined along the longitudinal side face of the second object (B) and two guiding wedges (14) are formed on the longitudinal side face of the first object (A) such that the two guiding wedges (14) are able to extend into the two guiding holes (24) to combine the first object (A) with the second object (B).

Figure 3:
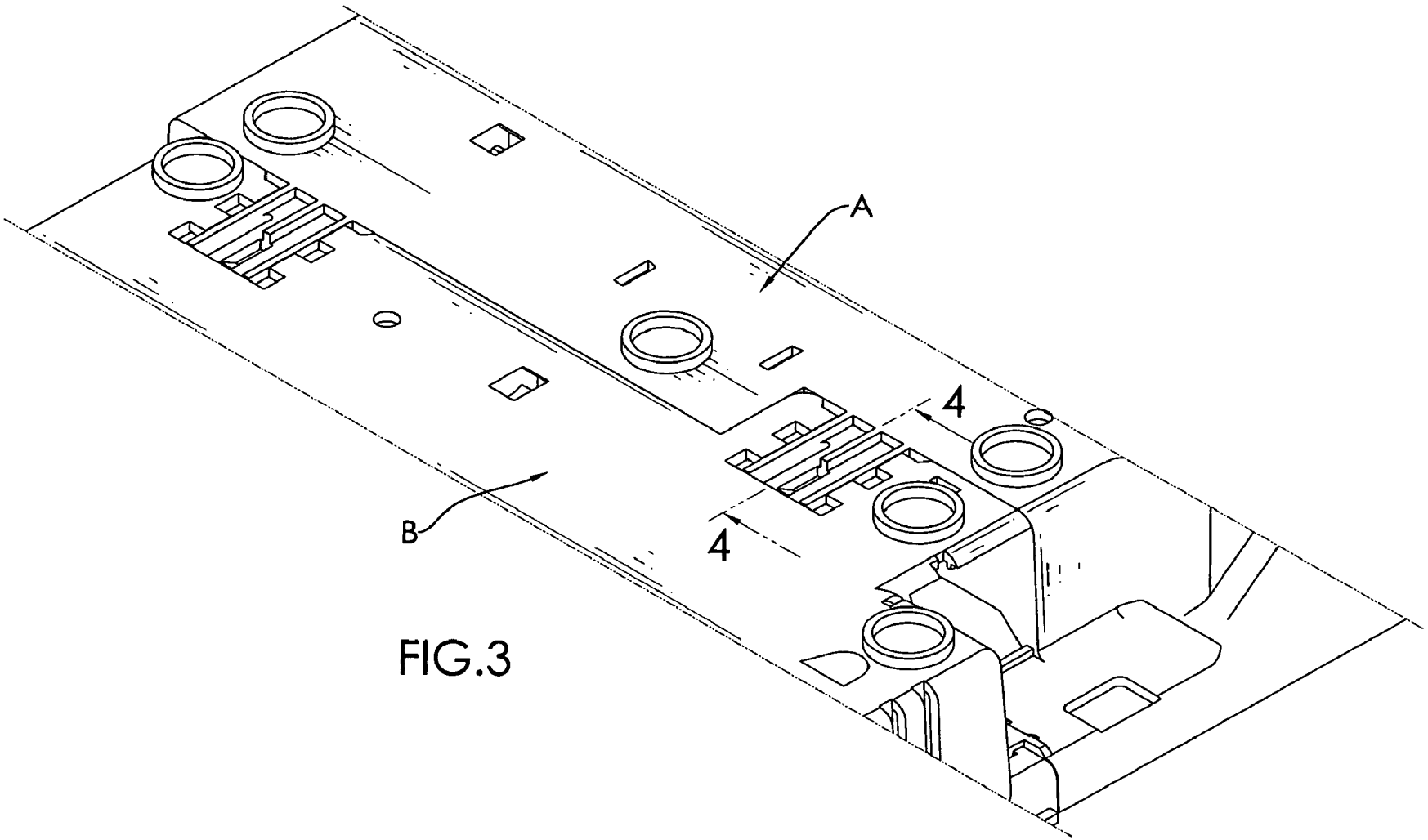
FIG. 3 is an enlarged perspective view showing the connection between the first male connector and the first female connector.
Figure 4:
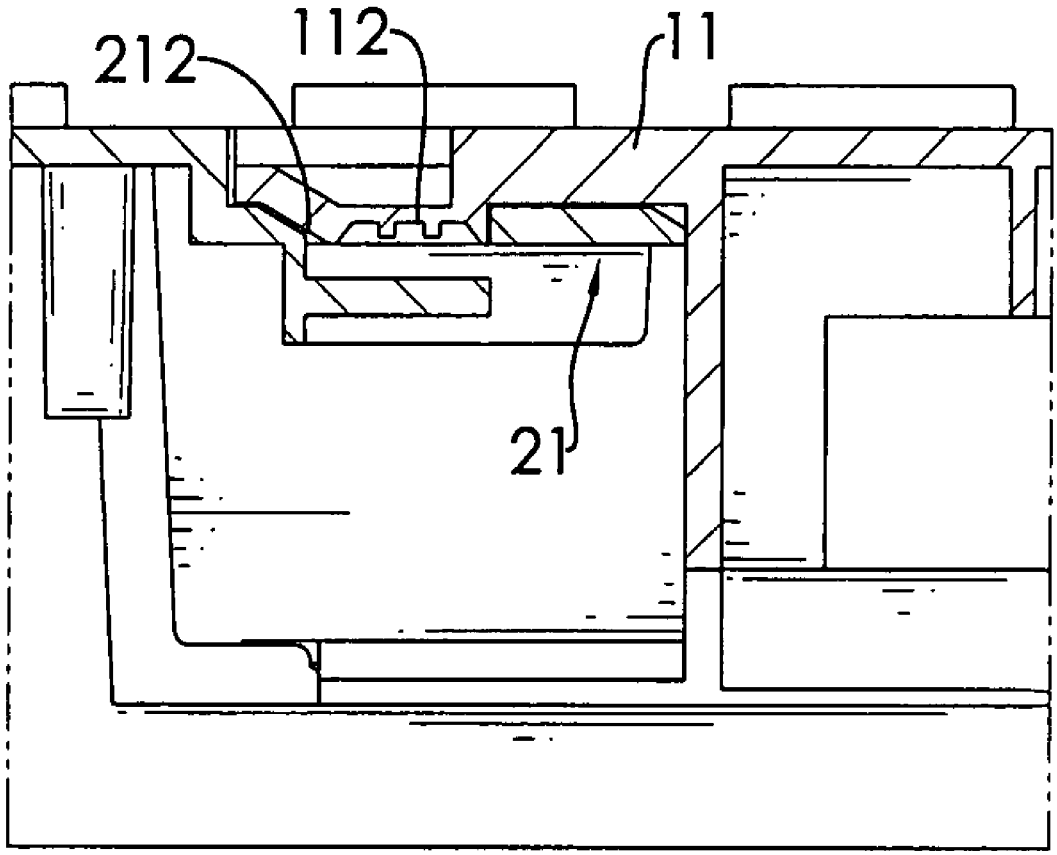
FIG. 4 is a schematic cross sectional view showing in detail the structural relationship between the first male connector and the first female connector.

With reference to FIGS. 3 and 4, when the first object (A) is combined with the second object (B), the first male connector (11) and the second male connector (13) are respectively inserted into the corresponding indentations (211, 231) with the boss (112, 132) from the first male connector (11) and the second male connector (13) received in the corresponding through holes (212,232). FIG. 4 shows the boss (112) of the first male connector (11) being received in the corresponding through hole (212) of the first female connector (21).

From the above mentioned description, it is noted that the first male connector (11) is zigzag to the second male connector (13). Also, the first female connector (21) is zigzag to the second female connector (23). Due to the zigzag relationship between the pair of male connectors and the pair of female connectors, the overall weight is evenly distributed between the first object (A) and the second object (B).

In addition to the pair of male connectors and the pair of female connectors, auxiliary wedges (15) are respectively formed on a side face defining the first cutout (12) and a side wall of the first object (A). Corresponding to the auxiliary wedges (15), there are locking holes (25) defined along the longitudinal side face of the second object (B) and the side face of the extension (22). Therefore, extending the auxiliary wedges (15) into the locking holes (25), the combination between the first object (A) and the second object (B) is firmly secured.

Because of the zigzag structural relationship between the pair of male connectors and between the pair of female connectors, after the combination between the first object (A) and the second object (B), the overall weight of the combination is evenly distributed so that the connection assembly of the present invention is well maintained even during transportation thereof.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. A connection assembly for offsetting tilting due to weight difference between a first object and a second object to be combined with the first object, the connection assembly comprising:

a first male connector adapted to be extended from a longitudinal side face of the first object and having a first tongue stamped in the first male connector and a first boss formed on a side face of the first tongue;

a second male connector linearly misaligned with the first male connector and adapted to be extended from a side face of the first object and having a second tongue stamped in the second male connector and a second boss formed on a side face of the second tongue;

a first female connector adapted to be formed on a longitudinal side face of the second object and having a first indentation adapted to be defined in a bottom face of the longitudinal side face of the second object to receive therein the first male connector and a first through hole defined in a bottom face defining the first indentation to receive therein the first boss of the first male connector; and a second female connector adapted to be formed on a side face of the second object and being linearly misaligned with the first female connector, the second female connector having a second indentation adapted to be defined in the bottom face of the longitudinal side face of the second object to receive therein the second male connector and a second through hole defined in a bottom face defining the second indentation to receive therein the second boss such that after combination between the first object and the second object is finished, an overall weight of the first object and the second object is redistributed to avoid tilting;

a cutout being defined in the longitudinal side face of the first object; and the second male connector being formed on a side face of the cutout such that the second male connector and the first male connector are misaligned.

2. The connection assembly as claimed in claim 1, wherein an extension is adapted to be formed on the longitudinal side face of the second object and the second female connector is formed on a side face of the extension such that the first female connector is misaligned with the second female connector.

3. The connection assembly as claimed in claim 1, wherein the linearly misaligned relationship between the first male connector and the second male connector is a zigzag relationship; and the linearly misaligned relationship between the first female connector and the second female connector is a zigzag relationship.

4. The connector assembly as claimed in claim 2 further comprising two guiding holes adapted to be defined in the longitudinal side face of the second object and two guiding wedges are adapted to be formed on the longitudinal side face of the first object such that extension of the guiding wedges into the guiding holes combines the first object and the second object.

5. The connector assembly as claimed in claim 4, wherein the first male connector further has a first wedge formed on a free end of the first male connector to engage with a side face defining the first through hole of the second object and a second wedge formed on a free end of the second male connector to engage with a side face defining the second through hole of the second object.

6. The connector assembly as claimed in claim 2, wherein auxiliary wedges are adapted to be respectively formed on a side face defining the first cutout and a side wall of the first object, locking holes are adapted to be defined along the longitudinal side face and a side face of the second object to correspond to the auxiliary wedges such that extending the auxiliary wedges into the locking holes, the combination between the first object and the second object is secured.

7. The connector assembly as claimed in claim 4, wherein auxiliary wedges are adapted to be respectively formed on a side face defining the first cutout and a side wall of the first object, locking holes are adapted to be defined along the longitudinal side face and a side face of the second object to correspond to the auxiliary wedges such that extending the auxiliary wedges into the locking holes, the combination between the first object and the second object is secured.

8. The connector assembly as claimed in claim 5, wherein auxiliary wedges are adapted to be respectively formed on a side face defining the first cutout and a side wall of the first object, locking holes are adapted to be defined along the longitudinal side face and a side face of the second object to correspond to the auxiliary wedges such that extending the auxiliary wedges into the locking holes, the combination between the first object and the second object is secured.

9. The connection assembly as claimed in claim 2, wherein the linearly misaligned relationship between the first male connector and the second male connector is a zigzag relationship; and the linearly misaligned relationship between the first female connector and the second female connector is a zigzag relationship.

10. The connection assembly as claimed in claim 4, wherein the linearly misaligned relationship between the first male connector and the second male connector is a zigzag relationship; and the linearly misaligned relationship between the first female connector and the second female connector is a zigzag relationship.

11. The connection assembly as claimed in claim 5, wherein the linearly misaligned relationship between the first male connector and the second male connector is a zigzag relationship; and the linearly misaligned relationship between the first female connector and the second female connector is a zigzag relationship.

12. The connection assembly as claimed in claim 6, wherein the linearly misaligned relationship between the first male connector and the second male connector is a zigzag relationship; and the linearly misaligned relationship between the first female connector and the second female connector is a zigzag relationship.

13. The connection assembly as claimed in claim 7, wherein the linearly misaligned relationship between the first male connector and the second male connector is a zigzag relationship; and the linearly misaligned relationship between the first female connector and the second female connector is a zigzag relationship.

14. The connection assembly as claimed in claim 8, wherein the linearly misaligned relationship between the first male connector and the second male connector is a zigzag relationship; and the linearly misaligned relationship between the first female connector and the second female connector is a zigzag relationship.

* * * * *